United States Patent [19]

Smith

[11] 4,197,907

[45] Apr. 15, 1980

[54] FLOATING HEAD SUPPORT SYSTEM FOR SHELL AND TUBE HEAT EXCHANGER

[75] Inventor: Hosea E. Smith, Baytown, Tex.

[73] Assignee: Exxon Research & Engineering Co., Florham Park, N.J.

[21] Appl. No.: 893,737

[22] Filed: Apr. 5, 1978

[51] Int. Cl.[2] ..... F28F 9/12

[52] U.S. Cl. ..... 165/76; 165/158

[58] Field of Search ..... 165/76, 158, 162

[56] References Cited

U.S. PATENT DOCUMENTS

| | | | |
|---|---|---|---|
| 1,939,034 | 12/1933 | Bennett | 165/76 |
| 2,181,486 | 11/1939 | Jenkins | 165/162 X |
| 2,181,704 | 11/1939 | McNeal | 165/162 X |
| 2,595,822 | 5/1952 | Uggerby | 165/162 X |
| 3,797,564 | 3/1974 | Dickinson | 165/158 X |

*Primary Examiner*—Samuel Scott
*Assistant Examiner*—Theophil W. Streule, Jr.
*Attorney, Agent, or Firm*—James E. Reed; David A. Roth

[57] ABSTRACT

In a shell and tube heat exchanger including a floating tube sheet to which a floating head is connected during assembly of the exchanger, the floating head is supported in the required position adjacent the tube sheet during the assembly operation by means of a supporting member extending outwardly from the face of the tube sheet.

5 Claims, 3 Drawing Figures

FLOATING HEAD SUPPORT SYSTEM FOR SHELL AND TUBE HEAT EXCHANGER

BACKGROUND OF THE INVENTION

1. Field of the Invention

This invention relates to shell and tube heat exchangers and is particularly concerned with improved exchangers provided with means for supporting the floating head in the required position adjacent the floating tube sheet during the assembly of such exchangers.

2. Description of the Prior Art

Shell and tube heat exchangers are widely used in chemical plants, petroleum refineries, steam plants and similar installations. Typically, such an exchanger includes an external shell having inlet and outlet ports for circulation of the shell-side fluid, an elongated bundle of tubes positioned within the shell, and transverse baffles for directing the shell-side fluid back and forth across the tubes. The tubes are supported by tube sheets, one of which is normally stationary and the other of which may be either stationary or "floating" to accommodate changes in tube length due to thermal expansion. The tube bundle and shell may be arranged so that the tube-side fluid makes a single pass through the shell or instead makes two or more passes. In a single pass exchanger, the tube-side fluid in introduced into a head at one end of the shell and withdrawn from a second head at the other end. In a multiple pass unit, the exchanger will generally be provided with one head containing one or more baffles so that the tube-side fluid can be introduced into one portion of the head and withdrawn from another portion. A second head containing one or more baffles which divert the tube-side fluid from one set of tubes into another will generally be located at the other end of the tube bundle. A wide variety of different shell and tube arrangements have been employed in the past.

Multiple pass shell and tube exchangers are often furnished with one fixed and one floating tube sheet, the floating tube sheet being fitted with a return or floating head. In order to reduce costs and increase the effectiveness of such exchangers, most floating heads are connected to the floating tube sheet by a clamp arrangement. An integral circular flange on the floating head and a split circular flange or ring make up the clamp. These pieces are bolted together with the floating tube sheet positioned between them, all of the connecting bolts being located beyond the outer edge of the tube sheet. A circular gasket is fitted between the floating head flange and tube sheet to prevent leakage.

The assembly of a unit of the type referred to above frequently presents difficulties. For proper leakfree operation, all of the parts must be precisely located when the final bolt tightening operation has been completed. The floating head-split ring assembly is normally free to rotate about the entire tube sheet and, since the split ring and floating head completely cover the tube sheet, must be positioned on the tube sheet without any reference marks or other guides to aid in its proper placement. Moreover, the parts are generally heavy and difficult to handle. This complicates the problem of positioning the head on the tube sheet with the precision necessary and often leads to the assembly of exchangers with the parts misaligned. Misfits, mechanical damage to the floating head and tube sheet, leakage of the joint, and extended installation time often result. These are not only costly but also hazardous, particularly in the case of exchangers intended for the handling of fluids at high temperatures and high pressures.

SUMMARY OF THE INVENTION

The present invention provides an improved method and apparatus which permits the installation of floating heads on shell and tube heat exchangers without the difficulties outlined above. In accordance with the invention, it has now been found that such difficulties can be largely eliminated by providing the floating tube sheet of such an exchanger with supporting members which engage the floating head and support it in the required position adjacent the tube sheet during assembly operations. The supporting members will normally extend outwardly from the tube sheet and engage a notched bar, shaped plate or similar member within the floating head. It is generally preferred that the supporting members be shoulder bolts threaded into holes in the face of the tube sheet near the upper end thereof and that the bar, plate or the like in the floating head be notched or otherwise shaped to seat on the shoulder bolts and hold the head in the required position so that it can be moved forward into place after the gasket has been properly spaced between the head flange and the split ring.

The system of the invention simplifies the assembly of floating head shell-and-tube heat exchangers, eliminates guesswork in positioning of the floating head of such exchangers during assembly operations, prevents damage to gaskets and other parts of such exchangers, permits more rapid makeup operations, assures proper alignment of exchanger parts, and results in improved safety and fewer accidents.

DESCRIPTION OF THE PREFERRED EMBODIMENTS

Figure 1:
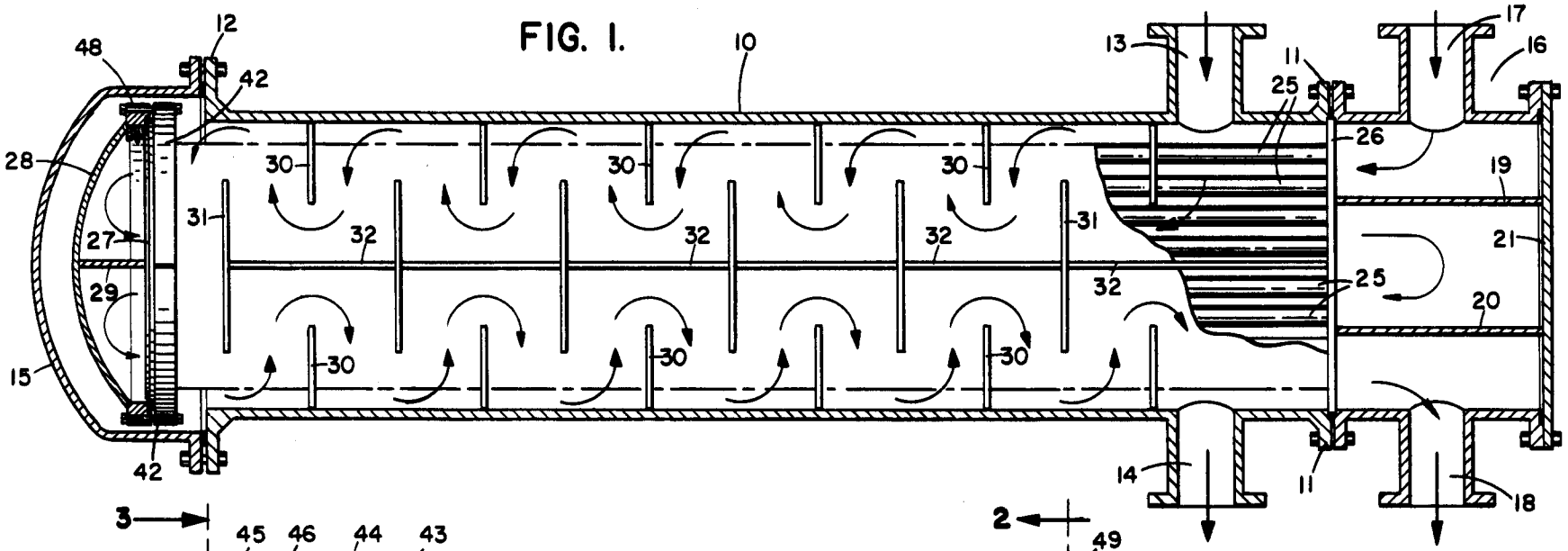
FIG. 1 in the drawing is a longitudinal cross-sectional view of a shell-and-tube heat exchanger having a floating head constructed in accordance with the invention.

The heat exchanger shown in the drawing is a multiple pass shell-and-tube unit in which the tube-side fluid makes four passes through the unit and the shell-side fluid makes two passes. The exchanger includes an elongated, generally cylindrical outer shell 10 having an external flange 11 at one end and a similar external flange 12 at the other end. The shell includes a fluid inlet 13 located near flange 11 and an opposed fluid outlet 14 located on the opposite side of the exchanger. A flanged head 15 is connected to the end of the shell adjacent flange 12 and a heat exchanger head 16 containing a tube-side fluid inlet 17 and a tube-side fluid outlet 18 is located at the other end of the shell adjacent flange 11. Head 16 contains internal baffles 19 and 20 which divert the tube-side fluid to permit four passes of the fluid through the tube side of the exchanger. A removable cover 21 is provided to permit access to the interior of head 16.

The tube bundle in the exchanger shown in the drawing comprises a plurality of elongated heat exchanger tubes 25 extending between a stationary tube sheet 26 containing openings in which the ends of the tubes are secured in the conventional manner and a floating tube sheet 27 including similar openings in which the opposite ends of the tubes are retained. A removable floating head 28 containing an internal baffle 29 is attached to the floating tube sheet as shown in greater detail in FIGS. 2 and 3 of the drawing. A plurality of transverse baffles 30 and 31 are mounted on the tube bundle to divert the shell-side fluid as it moves through the shell and insure proper contact with the tube surfaces. A longitudinal baffle 32 extends between the stationary tube sheet 26 and the last transverse baffle to force the shell-side fluid to make two passes through the shell. The tubes in the tube bundle may be arranged in a square pitch or in-line pattern or in a staggered or rotated square pitch pattern.

Figure 3:
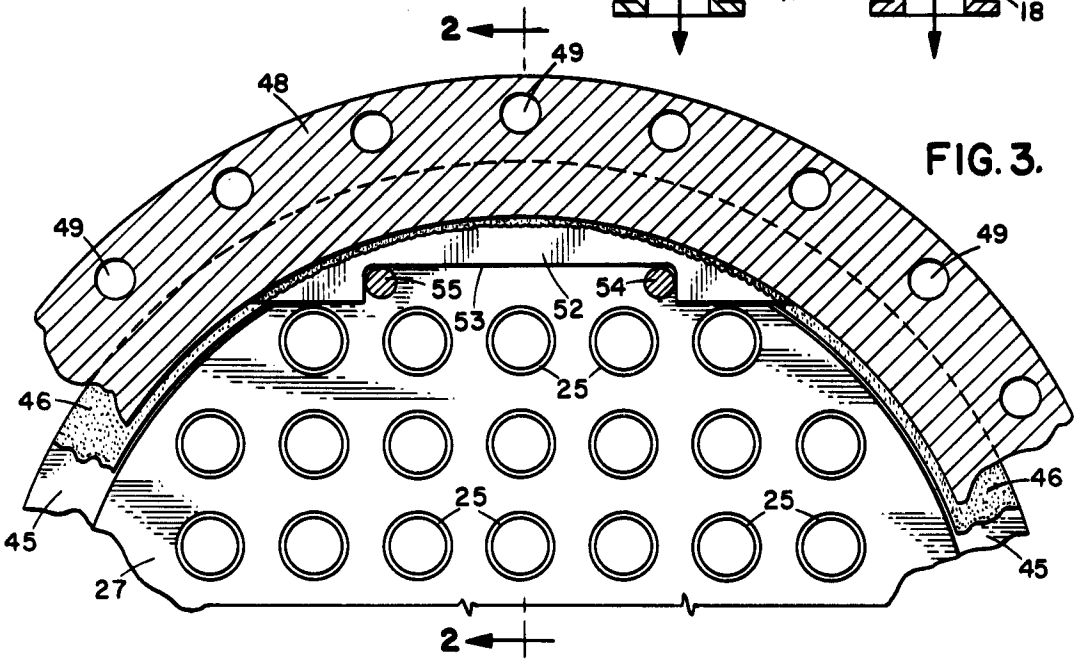
FIG. 3 is a cross-sectional view of the exchanger of FIGS. 1 and 2 taken about the line 3—3 in FIG. 2.
Figure 2:
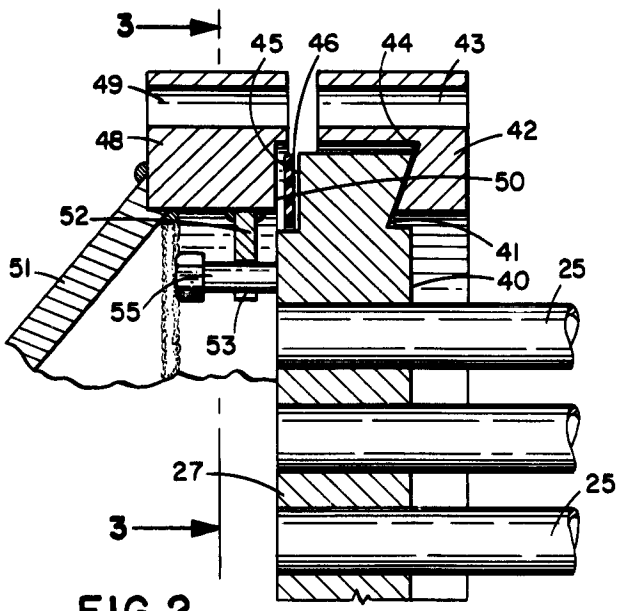
FIG. 2 is an enlarged fragmentary view of the exchanger of FIG. 1 illustrating the construction of the floating head in greater detail.

The construction of the floating head in the exchanger of FIG. 1 is shown in greater detail in FIGS. 2 and 3 of the drawing. As can be seen from FIG. 2, the ends of heat exchanger tubes 25 are secured in floating tube sheet 27 in the conventional manner. The inner face 40 of the tube sheet adjacent the tubes contains a tapered circumferential notch 41 in which split ring 42 seats. The split ring, only a portion of which is shown, contains bolt holes 43 and is provided with a tapered surface 44 which bears against the tapered surface in notch 41. The outer face of the floating tube sheet contains a circumferential gasket recess 45 within which a circular gasket 46 is positioned. The invention may be employed with any of several different split ring and tube sheet configurations used by various heat exchanger manufacturers.

The floating head in the exchanger shown in the drawing includes an outer flange member 48 containing bolt holes 49 at spaced points about its circumference and an inner recessed surface 50 against which gasket 46 seats. A dished head member 51 is welded to the surrounding flange to form the floating head. A plate or similar positioning member 52 is welded to the upper part of the flange inside the head and contains a notched or recessed center section 53 as shown more clearly in FIG. 3. This positioning member is located so that the floating head and the baffle contained therein will be in the proper position with respect to the tube sheet when it is in an uppermost position as illustrated in FIGS. 2 and 3. The positioning member rests on shoulder bolts or similar support members 54 and 55 which are threaded into holes in the outer face of the tube sheet. The shoulder bolts are sufficiently long to permit inspection of the gasket when the head is supported near the outer ends of the bolts. The bolt heads prevent the floating head from slipping off of the bolts. The head can be slid forward on the bolts until the flange face 50 contacts gasket 46. With the head in this position, the bolt holes 43 in the split ring can be aligned with the holes 49 in the floating head and the assembly can then be made up by inserting bolts through the holes and tightening the nuts in place.

It will be apparent that the invention is not restricted to the use of shoulder bolts and a positioning member of the exact configuration shown in the drawing. In lieu of using two bolts and a positioning member having a wide notched section as shown, for example, it may in some cases be preferred to employ a single shoulder bolt or similar support member and a positioning member having a much narrower notch. Other arrangements which may be used will suggest themselves to those skilled in the art.

It can be seen from the foregoing that the invention provides a simple and effective method for the installation of floating heads and split rings on heat exchangers which largely eliminates the difficulties encountered heretofore. By placing the gasket in position on the tube sheet, hanging the floating head on the shoulder bolts with the gasket exposed, checking the gasket for proper position, slidng the floating head forward into its final position, and then placing the split ring in position for bolting up, the installation can be completed quickly and with little or no chance for error. Guess work with respect to the final position of the gasket and damage to parts are largely eliminated. The chances of dropping the floating head during installation are greatly reduced and hence safety is enhanced. As a result of these and other advantages, the system of the invention has widespread potential application.

I claim:

1. In a shell and tube heat exchanger having a floating head and a floating tube sheet to which said floating head is connected during the assembly of said exchanger and having tubes connected to said tube sheet, the improvement which comprises a positioning support member extending outwardly from the face of said tube sheet near the upper end thereof in a direction opposite said tubes and means within said floating head adapted for mounting said head on said positioning support member and adapted for sliding the head into its proper position adjacent said tube sheet.

2. An exchanger as defined by claim 1 wherein said support member comprises a shoulder bolt.

3. An exchanger as defined by claim 1 wherein said means adapted for mounting said head and adapted for sliding the head into position comprises a notched plate.

4. In a shell and tube heat exchanger having tubes connected to a floating head which is connected to a floating tube sheet by means of a split ring mounted on the tube side of the tube sheet during assembly of the exchanger, the improvement which comprises a shoulder bolt threaded into an opening in the head side of the tube sheet near the upper end thereof, said shoulder bolt extending outwardly from the face of said tube sheet in a direction away from said tubes into the interior of said floating head when the head is positioned adjacent said tube sheet, and a plate extending substantially parallel to said tube sheet within said floatng head, said plate containing a notch within which said shoulder bolt supports and positions the head in the proper slidable position adjacent the tube sheet.

5. An exchanger as defined by claim 4 wherein said tube sheet is provided with two shoulder bolts extending outwardly from the face of the tube sheet adjacent the head and said plate contains a notch sufficiently wide for the plate to seat the slide upon both shoulder bolts simultaneously.

* * * * *